United States Patent [19]

Debs

[11] 4,335,776

[45] Jun. 22, 1982

[54] TASSEL WEIGHT

[75] Inventor: Victor Debs, Staten Island, N.Y.

[73] Assignee: Levolor Lorentzen, Inc., Hoboken, N.J.

[21] Appl. No.: 136,446

[22] Filed: Apr. 2, 1980

[51] Int. Cl.[3] ..... E06B 9/20

[52] U.S. Cl. ..... 160/320; 16/218

[58] Field of Search ..... 160/319, 320; 16/1 R, 16/209, 216, 217, 218, 219, DIG. 8; 220/DIG. 25

[56] References Cited

U.S. PATENT DOCUMENTS

| | | | |
|---|---|---|---|
| 1,426,224 | 8/1922 | Schneider | 16/218 |
| 1,463,877 | 8/1923 | Dickinson | 16/218 |
| 1,766,373 | 6/1930 | Bowers | 16/217 |
| 2,712,880 | 7/1955 | Moore | 220/DIG. 25 |
| 2,731,167 | 1/1956 | Moore | 220/DIG. 25 |

FOREIGN PATENT DOCUMENTS

| | | | |
|---|---|---|---|
| 49204 | 5/1974 | Australia | 16/209 |

*Primary Examiner*—C. J. Husar
*Assistant Examiner*—Cherney S. Lieberman

[57] ABSTRACT

A tassel weight for a control cord of a vertical blind, having a body with a hollow interior to be filled by the required number of weights, and a metal strip extending around the body and holding the weights in the interior and the pulley of the control cord in place.

3 Claims, 7 Drawing Figures

TASSEL WEIGHT

BACKGROUND OF THE INVENTION

The present invention relates to vertical blinds, and more specifically to a tassel weight for such vertical blind. Compared to horizontal or venetian blinds in which usually a very small tassel weight is sufficient, problems are encountered with vertical blinds because the control cord extends from one end of the blind head to the other and therefore will sag and show outside the blind head between the supports. Aside from being unsightly, this may interfere with the proper operation of the vertical blind, i.e. its opening and closing. Therefore a tension device, such as a tassel weight has to be attached to the control cord.

Heretofore, such tassel weights were made for instance of a solid metal block or an integral body made of synthetic material. This has proven unsatisfactory since a large number of tassel bodies of different weights had to be provided for vertical blind heads of different lengths.

It is, therefore, an object of the present invention to provide a tassel weight which overcomes this disadvantage.

It is also an object of the present invention to provide the tassel weight with new decorative features.

BRIEF SUMMARY OF THE INVENTION

The tassel weight of the invention consists of a hollow tubular body that can be filled with the required number of weights so as to be suitable for a large number of vertical blind heads of different lengths. It also comprises a decorative slat that may be made of the same material and color as the vanes of the vertical blind or as a valance that frequently is provided at the top of the vertical blind head, or it may be of a contrasting color.

BRIEF DESCRIPTION OF THE DRAWINGS

The invention is illustrated by way of example in the accompanying drawings, in which.

DETAILED DESCRIPTION OF PREFERRED EMBODIMENTS

Figure 1:
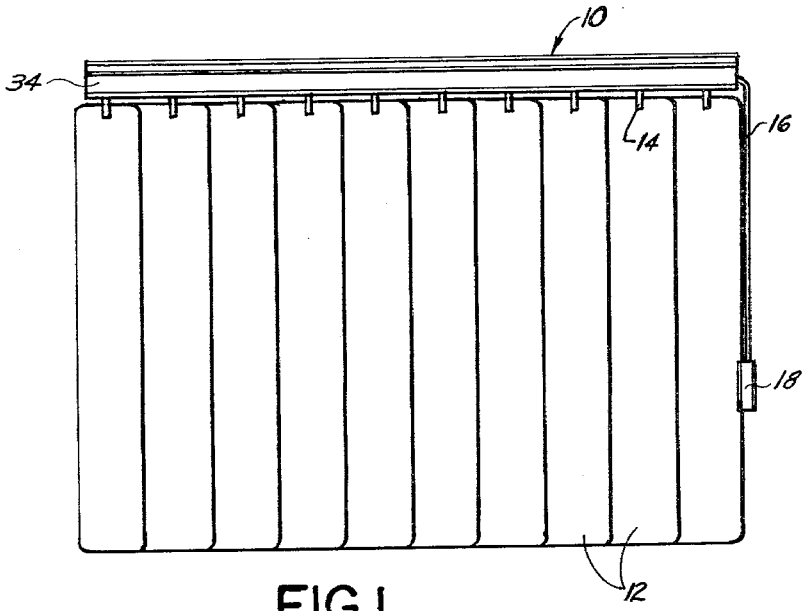
FIG. 1 is a front view of a vertical blind, including a blind head, a number of vanes suspended from the blind head and the tassel weight according to the present invention.
Figure 2:
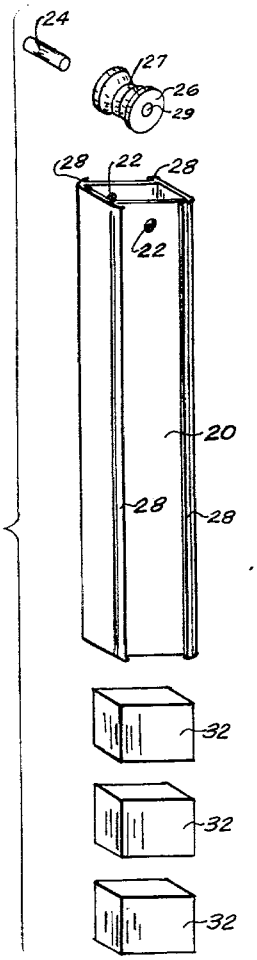
FIG. 2 is a perspective and exploded view of the tassel weight of FIG. 1.
Figure 3:
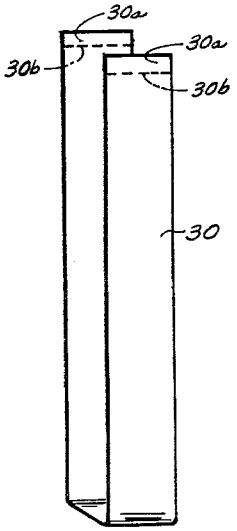
FIG. 3 is a perspective view of a slat for placement around a part of the tassel weight in order to complete the structure.
Figure 4:
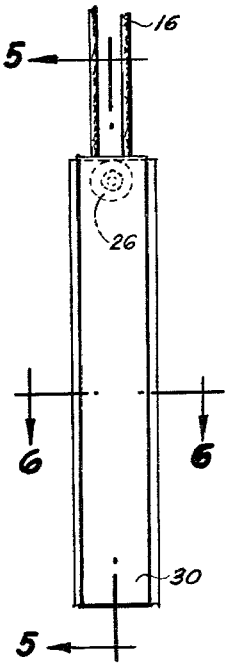
FIG. 4 is a side view of the assembled tassel weight.
Figure 5:
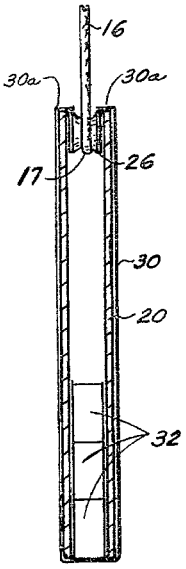
FIGS. 5 and 6 are respectively sections along Lines 5—5 and 6—6 in FIG. 4.
Figure 6:
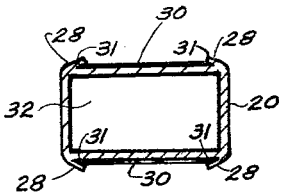

Referring now to the drawings in detail, FIG. 1 is a front view of a vertical blind including a blind head 10 for suspension from a ceiling or the like. In well-known manner a number of vanes 12 are suspended from hooks 14 which in turn are supported by carriers (not shown) within the blind head. Opening and closing of the blind is controlled by a cord 16. In order to keep the cord 16 taut and prevent sagging of the cord within the vertical blind head 10 there is provided a tassel weight 18. All elements described so far are well-known in the art and do not need any specific description. The present invention, however, is concerned with the specific design of the weight 18 which will now be explained in detail in connection with FIGS. 2 to 7.

Weight 18 is composed of a tassel body 20 made by extrusion, for instance from aluminum. Body 20 has in the upper part thereof two aligned bores 22 which are adapted to receive a pin 24 for supporting a roller or pulley 26 around which the cord 16 passes. Body 20 is also provided with flanges 28 defining grooves 31 for receiving therein a relatively thin metal body 30, such as a slat made of aluminum (see FIG. 3). The tassel weight 18 also includes a number of weights 32, such as metal blocks. Depending on the length of the cord the number of weights may vary to make certain that the cord 16 is always held taut and does not sag excessively within the vertical blind head.

The tassel weight is assembled as follows:

The looped end 17 of cord 16 is placed in the groove 27 of roller 26, whereupon the roller 26 with the cord 16 is introduced into the top of tassel body 20 so that a bore 29 in roller 26 is aligned with bores 22, whereupon the pin 24 is passed through the aligned bores 22 and 29. Thereafter, the appropriate number of weights 32 is introduced from below into the interior of tassel body 20 and the slat 30 is pushed from underneath into grooves 31. After slat 30 has reached its end position against the bottom of body 20 there will protrude from the top portions **30*a* of the slat 30 which are then bent inwardly as shown in the FIG. 5. This will hold pin 24 and roller 26 in the proper position within body 20 and prevent them from becoming lost. In order to facilitate bending of portions 30*a* the slat 30 may previously have been scored at 30*b*. The sot 30 may be made from the same material and of the same color as the vanes 12 of the vertical blind or a valance 34 at the blind head 10**. Of course, it could also have a contrasting color.

Figure 7:
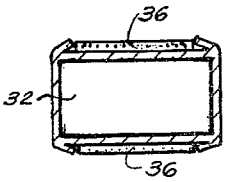
FIG. 7 is a section similar to that of FIG. 6 through an alternative embodiment.

An alternative embodiment is shown in FIG. 7 in which a relatively thick material 36 (compared to slat 30) is placed around body 20 and connected thereto for instance with adhesive.

I claim:

1. A tassel weight for a control cord of a vertical blind, comprising: an oblong tassel body of tubular configuration open from one end thereof to the other and having two pairs of opposite walls, a pair of opposite bores extending through said body adjacent said one end through one of said pairs of walls, a bearing pin supported in said bores, a roller supported by said bearing pin and received within said body and adapted to receive said cord therearound, weight means in said tassel body between said roller and said other end, and an essentially U-shaped metal strip covering one wall of said one pair of walls, the other end of said tassel body thereby closing the same, and the other wall of said one pair of walls, said strip having bent portions extending partially around said one end of said tassel body, said strip forming the sole means carrying said weight means and preventing the same from being displaced from said body when said tassel weight is suspended by said core and for keeping said pin axially in place in said bores.

2. A tassel weight according to claim 1, wherein said pair of opposite walls is provided with groove means receiving said strip.

3. A tassel weight according to claim 1, wherein said strip is connected to said pair of opposite walls by adhesive.

* * * * *